US010561238B1

(12) United States Patent
Gutierrez

(10) Patent No.: US 10,561,238 B1
(45) Date of Patent: Feb. 18, 2020

(54) INTERLOCKING BEVERAGE HOLDERS

(71) Applicant: John Gutierrez, Mandeville, LA (US)

(72) Inventor: John Gutierrez, Mandeville, LA (US)

( * ) Notice: Subject to any disclaimer, the term of this patent is extended or adjusted under 35 U.S.C. 154(b) by 0 days.

(21) Appl. No.: 15/785,739

(22) Filed: Oct. 17, 2017

Related U.S. Application Data

(60) Provisional application No. 62/484,234, filed on Apr. 11, 2017.

(51) Int. Cl.
*A47B 73/00* (2006.01)
*A47F 7/28* (2006.01)

(52) U.S. Cl.
CPC ..... *A47B 73/006* (2013.01); *A47F 7/283* (2013.01)

(58) Field of Classification Search
CPC ..... A47B 73/006; A47B 73/00; A47F 7/283
USPC ..... 206/504; 220/23.4
See application file for complete search history.

(56) References Cited

U.S. PATENT DOCUMENTS 3,194,426 A * 7/1965 Brown, Jr. ..... B65D 21/0204 220/23.4
4,262,467 A * 4/1981 Faisant ..... A01G 9/027 52/311.2
4,270,662 A 6/1981 Gonzales
4,299,100 A * 11/1981 Crisman ..... B65D 81/3883 220/592.17
4,681,239 A * 7/1987 Manns ..... B65D 81/3879 215/12.1
4,720,023 A * 1/1988 Jeff ..... A47G 19/2288 215/12.1
4,770,297 A * 9/1988 Chang ..... B65D 85/28 206/379
4,870,837 A * 10/1989 Weins ..... B65D 81/3883 215/13.1
5,024,067 A * 6/1991 Maier, II ..... B65D 21/0204 220/23.4
5,417,327 A 5/1995 Saumure
5,862,937 A * 1/1999 Carrizales ..... F25D 31/007 206/5
5,947,305 A * 9/1999 Lin ..... A47B 73/006 211/74
6,296,541 B1 * 10/2001 Bezalel ..... A63H 33/08 206/504
6,502,711 B1 * 1/2003 Mc Rae ..... B65D 21/0204 211/71.01

(Continued)

FOREIGN PATENT DOCUMENTS

DE 29801206 U1 * 3/1998 ..... A47B 73/006
DE 102007053683 A1 * 5/2009 ..... B65D 21/0204

*Primary Examiner* — Stanton L Krycinski
(74) *Attorney, Agent, or Firm* — Kenneth L Tolar

(57) ABSTRACT

Interlocking, detachable beverage holders each include a block having a central beverage receptacle that is dimensioned and configured to receive and conform to a wine bottle or similar container. The beverage receptacle is defined by a continuous inner wall having a plurality of ribs longitudinally positioned thereon that stabilize a stored container. Each block exterior includes a plurality of protrusions, notches, rims and concave cleats that seamlessly intermesh with those of other blocks allowing multiple blocks to be interconnected like jigsaw puzzle pieces. Each block contains a refrigerant that reaches a frigid temperature when placed within a freezer to chill a beverage stored within the beverage receptacle.

7 Claims, 4 Drawing Sheets

(56) References Cited

U.S. PATENT DOCUMENTS

| | | | | |
|---|---|---|---|---|
| 7,004,336 | B2 * | 2/2006 | Dagan | A47B 73/006 211/181.1 |
| 7,240,513 | B1 * | 7/2007 | Conforti | A45C 13/02 62/457.2 |
| 7,316,123 | B2 | 1/2008 | Gano | |
| 7,614,495 | B1 | 11/2009 | Smithers | |
| 7,614,516 | B2 * | 11/2009 | Beggins | B65D 81/3879 215/386 |
| 7,784,759 | B2 * | 8/2010 | Farrell | B65D 81/3879 215/232 |
| 7,963,411 | B2 * | 6/2011 | Nolle | B65D 21/0204 206/504 |
| 8,191,718 | B2 * | 6/2012 | Hovatter | B01L 9/06 206/504 |
| 8,307,670 | B2 | 11/2012 | Stewart et al. | |
| 9,346,585 | B2 * | 5/2016 | Hendrickson | B65D 21/0204 |
| 9,618,252 | B2 * | 4/2017 | Andrews | F25D 3/08 |
| 2005/0011842 | A1 * | 1/2005 | Gideon | A47B 73/006 211/74 |
| 2006/0096942 | A1 | 5/2006 | Lane | |
| 2006/0261063 | A1 * | 11/2006 | Dyehouse | B65D 21/0204 220/23.4 |
| 2007/0108145 | A1 | 5/2007 | Milardo et al. | |
| 2009/0090647 | A1 * | 4/2009 | Panchal | B62D 21/0204 206/504 |
| 2014/0091099 | A1 | 4/2014 | Prehal | |

* cited by examiner

INTERLOCKING BEVERAGE HOLDERS

CROSS REFERENCE TO RELATED APPLICATIONS

This application is entitled to the benefit of provisional patent application No. 62/484,234 filed on Apr. 11, 2017, the specification of which is incorporated herein by reference.

BACKGROUND OF THE INVENTION

The present invention relates to interlocking, freezable beverage holders, any number of which can be interconnected to form a wine rack or similar beverage storage apparatus having a desired capacity.

DESCRIPTION OF THE PRIOR ART

Wine racks are a convenient means of stacking and storing multiple wine bottles within a compact space. However most wine racks are bulky and cumbersome to disassemble for transport or storage. Therefore, those participating in certain outdoor events or traveling cannot practically use a beverage rack. In addition, a conventional rack is exposed to ambient conditions that often maintain a wine at an undesirable serving temperature. Furthermore, extreme or varying ambient temperatures can ruin perishable beverages that should be stored in a temperature-controlled environment.

Accordingly, there is currently a need for a device that allows multiple beverage containers to be conveniently stored at a desirable temperature and which can be quickly and easily disassembled for transport or storage. A review of the prior art reveals a myriad of beverage holders. For example, U.S. Pat. No. 7,614,495 issued to Smithers discloses a modular beverage-can interlocking device that allow cans to be formed into building blocks for use as toys.

U.S. Pat. No. 7,316,123 issued to issued to Gano discloses an insulating container for beverages including a temperature-maintaining material that sublimates and releases to the atmosphere in warmer weather.

U.S. Pat. No. 5,417,327 issued to Saumure discloses elongated, tubular, insulated beverage holders that can each be attached to another at either end thereof.

U.S. patent no. 2016/0120307 issued to Salani discloses a wine bottle-rack building kit including plates with bottle-receiving apertures. Each plate includes slots for attaching to other plates to form a rack.

U.S. Pat. No. 4,270,662 issued to Gonzales discloses a wine rack formed of a plurality of modular members that can be interconnected to form one or more bottle-receiving openings.

U.S. patent no. 2006/0096942 issued to Lane discloses stackable water bottles.

U.S. patent no. 2007/0108145 issued to Milardo discloses a collapsible wine rack or bottle holder.

Although several modular or interlocking beverage holders exist in the prior art, they include numerous components that are cumbersome to erect and disassemble. Furthermore, in order to be compactly stowed, the prior art devices must be completely disassembled, which is laborious and burdensome. Moreover, although a few of the devices include insulation to impede heat transfer, none include a self-contained temperature control means for chilling beverages while being stored.

The present invention overcomes the deficiencies of the prior art by providing uniquely designed, attachable beverage holders, each containing a refrigerant therein for chilling a stored beverage. Each holder includes multiple arcuate, tongue-and-groove-type connectors for quickly securing one holder to another. Therefore, multiple holders can be interconnected to form a beverage storage rack having a desired capacity.

SUMMARY OF THE INVENTION

The present invention relates to a plurality of interlocking, detachable beverage holders that can be combined to form a wine rack or similar storage apparatus. Each holder includes a block having a central beverage receptacle that is dimensioned and configured to receive and conform to a wine bottle or similar container. The beverage receptacle is defined by a continuous inner wall having a plurality of ribs longitudinally positioned thereon that stabilize a stored container. Each block exterior includes a plurality of protrusions, notches, rims and concave cleats that seamlessly intermesh with those of other blocks allowing multiple blocks to be interconnected like jigsaw puzzle pieces. Each block contains a refrigerant that chills to an extremely low temperature when placed within a freezer to cool a beverage stored within the beverage receptacle.

It is therefore an object of the present invention to provide interlocking beverage holders that can be quickly and conveniently interconnected to form a beverage rack.

It is another object of the present invention to provide interlocking beverage holders that chill a stored beverage.

It is yet another object of the present invention to provide interlocking beverage holders that are easily stored within a bag or other container when assembled.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
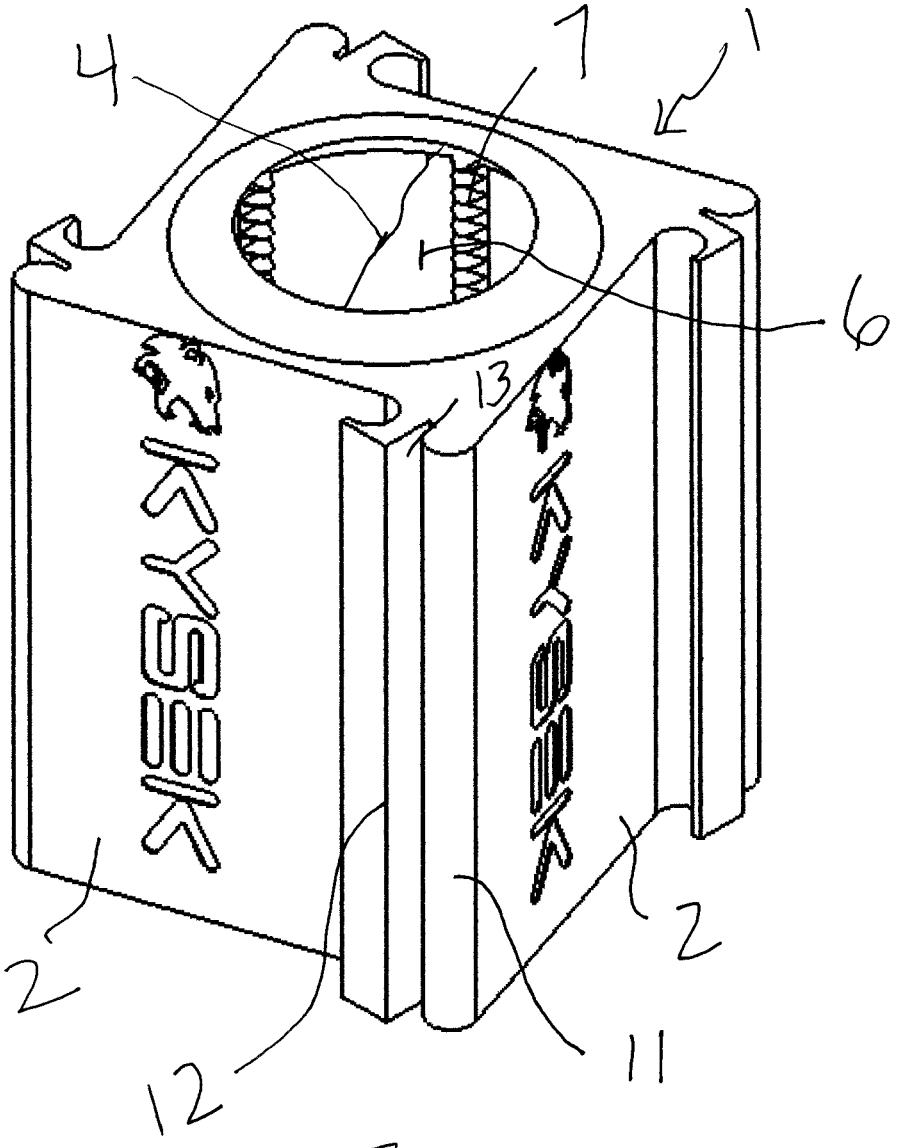
FIG. 1 is a perspective view of a beverage holder according to the present invention.
Figure 2:
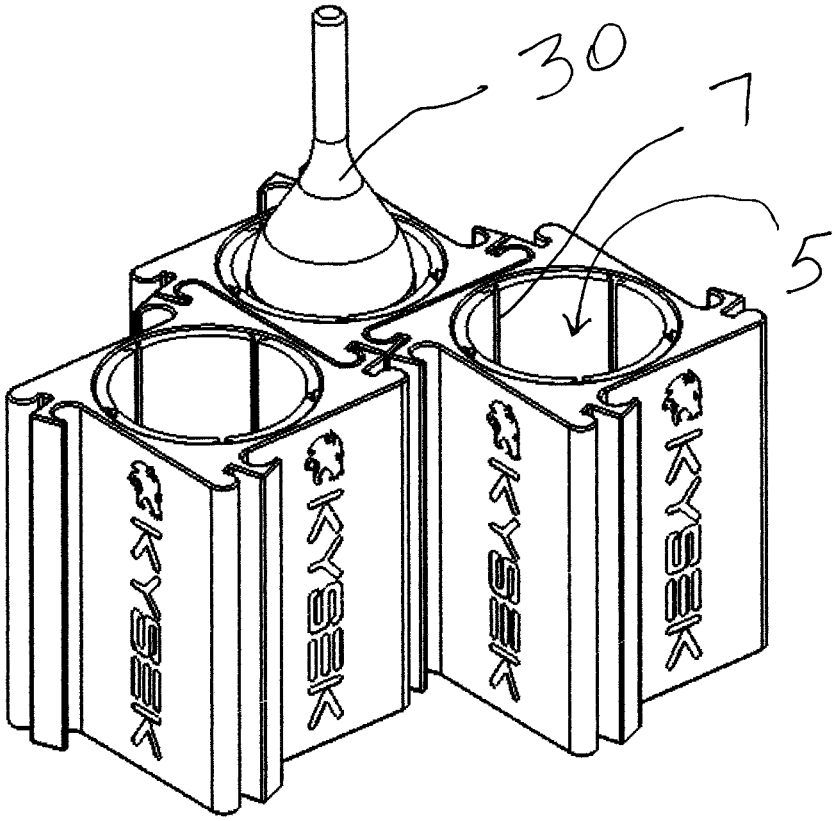
FIG. 2 depicts multiple interconnected beverage holders storing a wine bottle.
Figure 3:
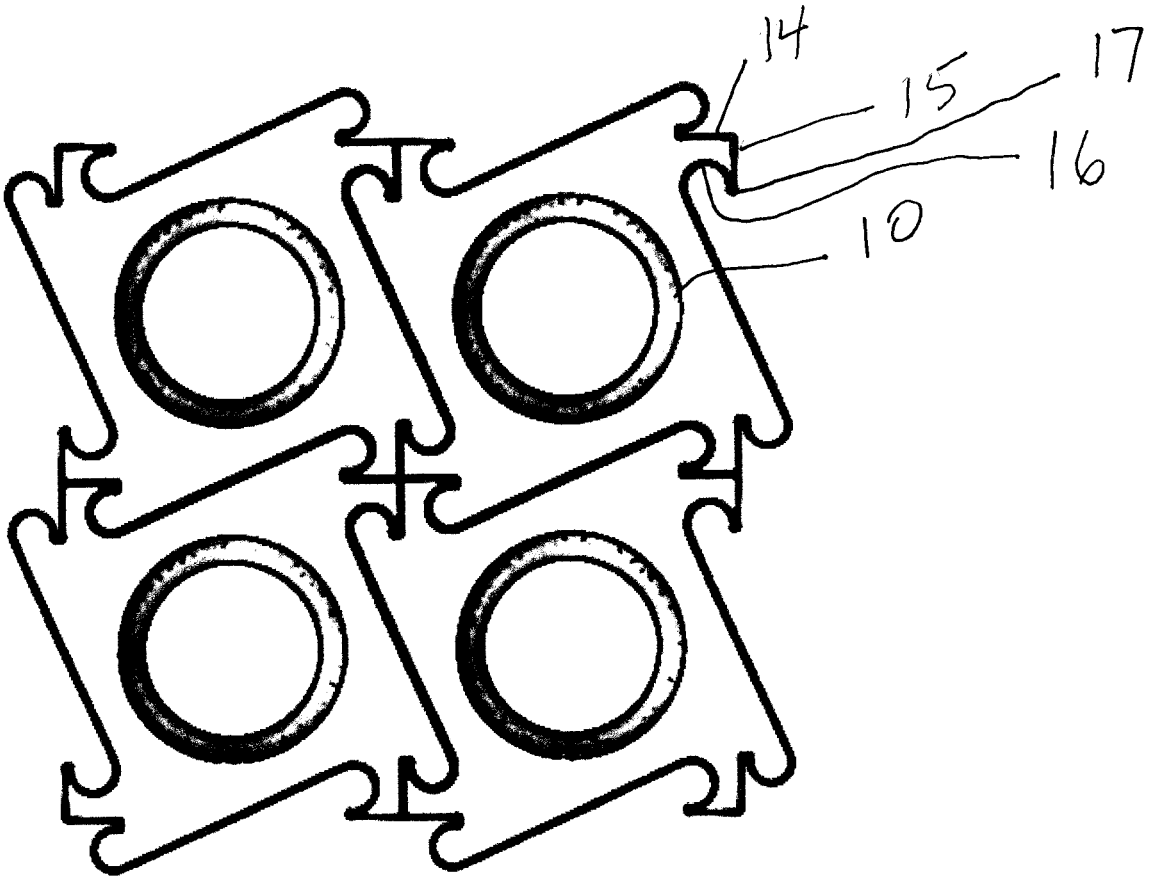
FIG. 3 is a top, plan view of multiple, interconnected blocks.
Figure 4:
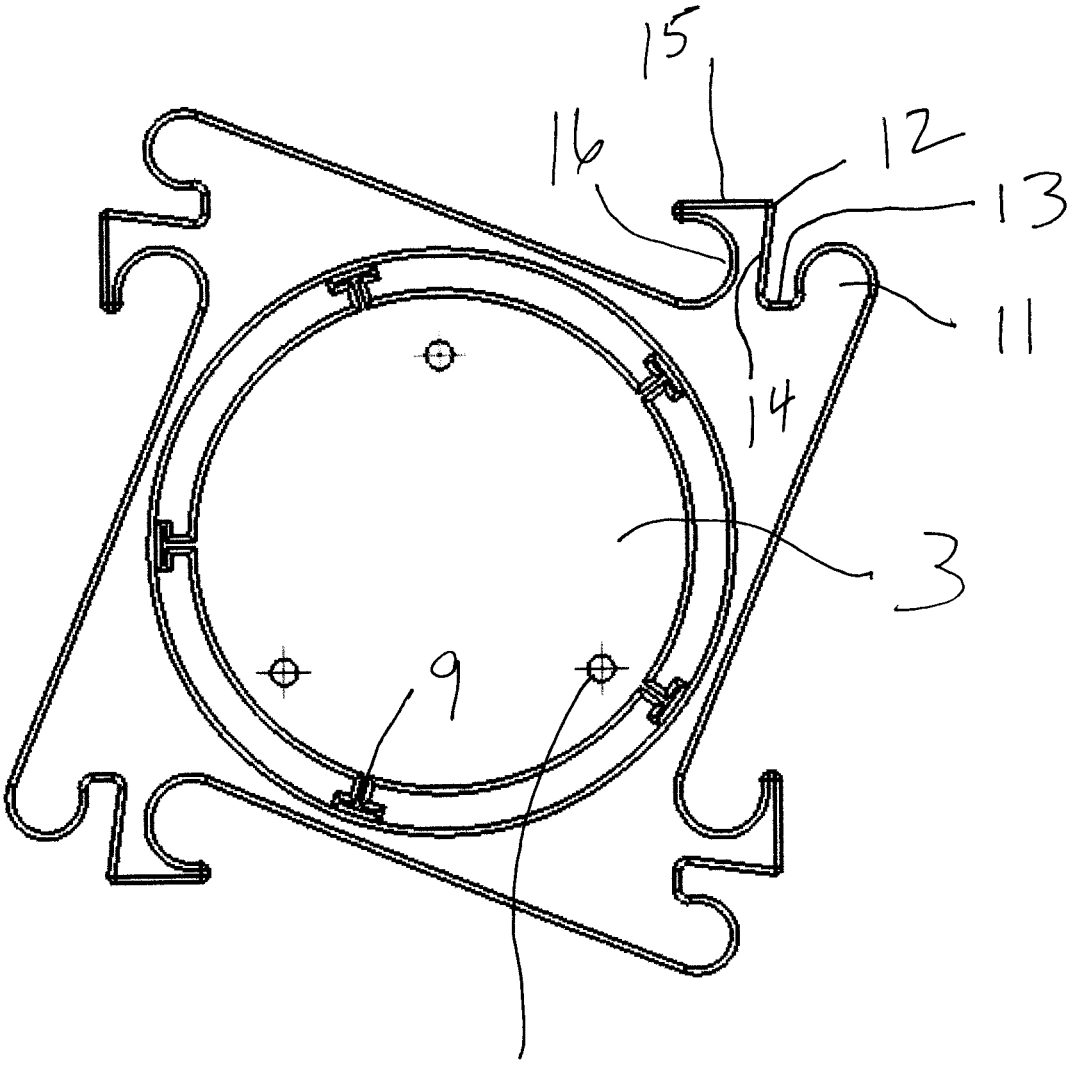
FIG. 4 is a top, plan view of a single block with the gasket removed to expose the T-shaped slots.

The present invention relates to a plurality of interlocking, detachable beverage holders that can be combined to form a wine rack or similar storage apparatus. Each holder includes a block 1 having a plurality of outer walls 2, a bottom surface 3 and an open upper end 4 in communication with a beverage receptacle 5 that is dimensioned and configured to receive and firmly conform to a beverage bottle 30 or similar beverage container. The bottom surface includes a plurality of weep holes 28 in communication with an underlying compartment for collecting condensation.

The beverage receptacle 5 is defined by a continuous, cylindrical inner wall 6 having a plurality of ribs 7 longitudinally positioned thereon that stabilize a stored bottle. The relative spacing and the total number of ribs are such that smaller beverage containers cannot fit between an adjacent pair of ribs and shift within the receptacle. Each rib preferably includes a T-shaped base that slides within a mating T-shaped slot 9 on the inner wall 6 to facilitate assembly. The open upper 4 end includes a continuous, elastomeric gasket 10 that conceals the ribs to aesthetically enhance the block while also forming a seal around the circumference of a beverage container.

Between each adjoining pair of sidewalls is a tubular protrusion 11 and a spaced L-shaped cleat 12 with a narrow notch 13 formed therebetween. The protrusion 11, the cleat 12 and the notch 13 preferably extend the entire length of the block from the open upper end 4 to the bottom surface 3. The cleat 12 includes a planar front surface 14, a planar top surface 15 perpendicularly extending from the front surface 14 and a concave rear surface 16 that terminates at the adjoining sidewall. Between the top surface 15 and concave rear surface 16 is a rim 17 that is dimensioned to firmly and slidably seat within the narrow notch 13 in a second block. Likewise, the concave rear surface 16 of the cleat 12 is dimensioned to firmly and slidably receive the tubular protrusion 11 on a second block so that two or more blocks may be securely interconnected to form a unitary structure that can hold multiple beverage bottles or containers. The interlocking protrusions, notches, rims and concave cleats form a secure connection even if multiple connected blocks are being transported in a bag, or are otherwise impacted, overturned, contorted or dropped.

The interior of each block, defined by the space between the outer walls 2 and the inner wall 6, contains a low-freeze-point refrigerant that reaches a frigid temperature when placed within a freezer. The refrigerant also maintains the frigid temperature for a prolonged duration when removed from the freezer to chill a beverage stored in the beverage receptacle. In the preferred embodiment, the refrigerant is carboxymethylcellulose (CMC), which has a low degradation rate and therefore has a longer useful life. Furthermore, CMC has a minimal penetration capability relative to the block material so that an initial supply of the material will remain after numerous freeze cycles. Finally, CMC is completely nontoxic to humans if inadvertently ingested. However, the type of refrigerant can be varied and could include any of those currently used in freezable gel packs.

As is readily apparent from the detailed description above, the present invention provides new and improved interlocking beverage holders that can be easily interconnected to form a storage rack having a desired capacity. Furthermore, one or more holders may be frozen prior to use to chill a beverage being stored in the beverage receptacle. The unique design of the arcuate, interlocking cleats, protrusions, and other mating surfaces significantly reduces injection-molding costs while also forming a secure connection that will not detach when the holders are contorted or impacted. Additionally, the configuration of the interlocking components reduces the overall size of interconnected blocks to allow them to be transported in many conventional bags or other storage containers without disassembling.

The above-described device is not limited to the exact details of construction and enumeration of parts provided herein. For example, although the device has been primarily depicted and described as a wine-bottle holder, the device can be configured to store a myriad of beverage containers, such as other beverage bottles or cans. The block is preferably constructed with food-grade, high-density polyethylene (HDPE) or a similar minimally conductive material. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An interlocking beverage holder comprising:

a block having a plurality of outer walls, a bottom surface and an open upper end in communication with a beverage receptacle, said beverage receptacle dimensioned and configured to receive and firmly conform to a beverage container; wherein said beverage receptacle is defined by a continuous, cylindrical inner wall having a plurality of ribs longitudinally positioned thereon that stabilize the beverage container; each of said ribs including a T-shaped base that slides within a mating T-shaped slot on the inner wall to facilitate assembly;

a tubular protrusion, a cleat spaced from said protrusion and an interposed notch positioned between each of an adjoining pair of said outer walls, said cleat having a rim that is dimensioned to firmly and slidably seat within the notch on a second said block.

2. The interlocking beverage holder according to claim 1 wherein the cleat includes a concave rear surface that is dimensioned to firmly and slidably receive the tubular protrusion on a second block so that two or more of said block are securely interconnected to form a unitary structure that holds multiple beverage bottles or containers.

3. The interlocking beverage holder according to claim 1 wherein said block includes an interior between said beverage receptacle and said outer walls, said interior containing a refrigerant that reaches a low temperature when placed within a freezer to chill a beverage received within the beverage compartment.

4. The interlocking beverage holder according to claim 1 wherein the open upper end includes a continuous, elastomeric gasket that conceals the ribs to aesthetically enhance the block while also forming a seal around the beverage container.

5. The beverage holder according to claim 1 wherein said block is constructed with food-grade, high-density polyethylene.

6. The beverage holder according to claim 1 wherein the bottom surface includes a plurality of weep holes in communication with an underlying compartment for collecting condensation.

7. The beverage holder according to claim 3 wherein said refrigerant includes carboxymethylcellulose.

* * * * *